US007992888B2

(12) United States Patent
Steere

(10) Patent No.: US 7,992,888 B2
(45) Date of Patent: Aug. 9, 2011

(54) BLOCKLESS HIGHBACK BINDING

(75) Inventor: Nigel Bruce Edward Steere, Seattle, WA (US)

(73) Assignee: K-2 Corporation, Seattle, WA (US)

( * ) Notice: Subject to any disclaimer, the term of this patent is extended or adjusted under 35 U.S.C. 154(b) by 83 days.

(21) Appl. No.: 12/328,137

(22) Filed: Dec. 4, 2008

(65) Prior Publication Data

US 2009/0146397 A1 Jun. 11, 2009

Related U.S. Application Data

(60) Provisional application No. 61/012,330, filed on Dec. 7, 2007.

(51) Int. Cl.
*A63C 9/10* (2006.01)

(52) U.S. Cl. ..... 280/624; 280/611; 280/617; 280/626; 280/14.22

(58) Field of Classification Search ..... 280/624
See application file for complete search history.

(56) References Cited

U.S. PATENT DOCUMENTS

| | | | |
|---|---|---|---|
| 3,775,872 | A | 12/1973 | Rathmell |
| 3,798,800 | A | 3/1974 | Rathmell |
| 4,072,317 | A | 2/1978 | Pommerening |
| 4,168,084 | A | 9/1979 | von Besser |
| 4,188,046 | A | 2/1980 | Fleckenstein |
| 4,265,034 | A | 5/1981 | Salomon |
| 4,379,370 | A | 4/1983 | Balbinot |
| 4,473,235 | A | 9/1984 | Burt |
| 4,499,676 | A | 2/1985 | Chalmers, II |
| 4,565,017 | A | 1/1986 | Ottieri |
| 4,669,202 | A | 6/1987 | Ottieri |
| 4,719,926 | A | 1/1988 | Nelson |
| 4,905,385 | A | 3/1990 | Perrissoud |
| 4,910,892 | A | 3/1990 | Perrissoud |
| 4,945,660 | A | 8/1990 | Perrissoud |
| 5,020,823 | A | 6/1991 | Bogner |
| 5,088,211 | A | 2/1992 | Walkhoff |
| 5,143,396 | A | 9/1992 | Shaanan |
| 5,216,826 | A | 6/1993 | Chaigne |
| 5,261,689 | A | 11/1993 | Carpenter |
| 5,356,170 | A | 10/1994 | Carpenter |
| 5,412,883 | A | 5/1995 | Wulf |
| 5,431,624 | A | 7/1995 | Saxton |
| 5,435,080 | A | 7/1995 | Meiselman |
| 5,505,477 | A | 4/1996 | Turner |
| 5,647,148 | A | 7/1997 | Meiselman |
| 5,727,797 | A | 3/1998 | Bowles |
| 5,802,741 | A | 9/1998 | Turner |
| 5,832,635 | A | 11/1998 | Finney |
| 5,890,730 | A | 4/1999 | Anderson |
| 5,899,483 | A | 5/1999 | Paris |
| 5,901,971 | A | 5/1999 | Eaton |

(Continued)

*Primary Examiner* — J. Allen Shriver, II
*Assistant Examiner* — Erez Gurari
(74) *Attorney, Agent, or Firm* — Christensen O'Connor Johnson Kindness PLLC

(57) ABSTRACT

A binding comprising a baseplate that is adapted to attach to a gliding board such as a snowboard, the gliding board having lateral and medial sidewalls and a heel loop, and a pivotably highback pivotably mounted to the baseplate. The heel loop includes at least one forwardly disposed tooth, and the highback includes a plurality of rearwardly disposed teeth. The maximum forward lean angle is established by the engagement of the heel loop and highback teeth. In one embodiment the highback adjustably attaches to the baseplate with hardware extending through arcuate slots, such that the maximum forward lean angle is determined by the position of the hardware in the slots.

24 Claims, 6 Drawing Sheets

U.S. PATENT DOCUMENTS

| | | | | |
|---|---|---|---|---|
| 5,906,058 | A | 5/1999 | Rench | |
| 5,909,886 | A | 6/1999 | Tugutaka | |
| 5,909,894 | A | 6/1999 | Meader | |
| 5,915,821 | A | 6/1999 | Okajima | |
| 5,926,979 | A | 7/1999 | Borel | |
| 5,971,422 | A | 10/1999 | Anderson | |
| 5,975,557 | A | 11/1999 | Snoke | |
| 5,979,082 | A | 11/1999 | Pallatin | |
| 5,984,325 | A | 11/1999 | Acuna | |
| 5,997,027 | A | 12/1999 | Jungkind | |
| 6,003,893 | A | 12/1999 | Hansen | |
| 6,007,077 | A | 12/1999 | Moe | |
| 6,012,237 | A | 1/2000 | Okajima | |
| 6,027,136 | A | 2/2000 | Phillips | |
| 6,032,974 | A | 3/2000 | Saillet | |
| 6,056,300 | A | 5/2000 | Carpenter | |
| 6,099,018 | A | 8/2000 | Maravetz | |
| 6,101,745 | A | 8/2000 | Grandin | |
| 6,102,429 | A | 8/2000 | Laughlin | |
| 6,105,993 | A | 8/2000 | Gignoux | |
| 6,113,127 | A | 9/2000 | Karol | |
| 6,116,634 | A | 9/2000 | Mometti | |
| 6,116,635 | A | 9/2000 | Rigal | |
| 6,123,354 | A | 9/2000 | Laughlin | |
| 6,231,057 | B1 | 5/2001 | Reuss | |
| 6,231,066 | B1 | 5/2001 | Okajima | |
| 6,247,252 | B1 | 6/2001 | Parisotto | |
| 6,267,403 | B1 | 7/2001 | Bossin | |
| 6,283,482 | B1 | 9/2001 | Coulter | |
| 6,554,296 | B1 * | 4/2003 | Dodge et al. | 280/14.22 |
| 6,672,610 | B2 | 1/2004 | Freisinger | |
| 6,736,413 | B2 | 5/2004 | Laughlin | |
| 6,840,532 | B2 | 1/2005 | Plassiard | |
| 2006/0237920 | A1 * | 10/2006 | Steere | 280/11.36 |

* cited by examiner

BLOCKLESS HIGHBACK BINDING

CROSS-REFERENCE TO RELATED APPLICATION

This application claims the benefit of U.S. Provisional Application No. 61/012,330, filed Dec. 7, 2007, the disclosure of which is incorporated herein by reference in its entirety.

FIELD OF THE INVENTION

The present invention is directed to bindings for gliding sports and more particularly to bindings having a pivotable highback support.

BACKGROUND

Gliding boards, such as snowboards, snow skis, water skis, and the like, are well known in the art and in the sporting world. Generally, a rider is securely held to the gliding board with a binding that connects to the gliding board and generally to the rider's feet or boots. Various types of bindings have been developed to allow the user to engage the gliding board. The present disclosure is described with reference to the currently preferred snowboard binding embodiments, although the present invention may readily be adapted for other gliding board applications.

Prior art snowboard binding systems are generally categorized as either strap (or conventional) bindings that typically include a rigid highback against which the back side of the boot is placed and one or more straps that secure the boot to the binding, or step-in bindings that typically utilize one or more strapless engagement members into which the rider can step to lock the boot into the binding. For example, the strapless engagement members may engage metal cleats integrated into the sole of the boot. Strap bindings are the earlier and most popular type of snowboard binding and are adjustable, secure, and comfortable. Step-in bindings allow the user to more easily engage and disengage from the snowboard.

Both strap bindings and step-in bindings usually include a highback ankle support that extends upwardly from the snowboard and is positioned to overlie the back of the user's boot. The back ankle portion of the rider's boot abuts against a curved forward surface of the highback, essentially providing leverage by which the rider can control the snowboard's heel edge. Alpine riders who need to perform high speed turns generally prefer a taller and stiffer highback for greater edge control, whereas freestyle riders generally prefer a shorter highback for better flexibility.

The maximum forward lean angle is herein defined to be the angle that the highback forms with the snowboard (or base plate of the binding) when the highback is pivoted to its rearward stop, and is illustrated as the angle $M_{FL}$ in FIG. 1C. The maximum forward lean angle is important to the feel and control of the snowboard. In prior art bindings the maximum forward lean angle is typically adjusted by the rider using a mechanical stop that is slidably disposed on the highback and abuts the top edge of the heel loop. A rider will slide and lock the block to provide a particular maximum forward lean angle that may be selected based on a variety of factors, including the type of snowboarding to be undertaken, the slope conditions, and the like.

Of course, the rider's ankles are important to controlling the snowboard and, in particular, the angular orientation of the snowboard relative to the snow about all three axes, and especially about the longitudinal axis. The human ankle is a complex system of flexible connections between the lower leg and foot that can be characterized as three separate joints. The first joint is the dorsiflexion ankle joint formed between the lower ends of the tibia and fibula and the uppermost bone in the foot, the talus. This joint allows movement of the foot in dorsiflexion/plantar flexion (i.e., toe up and down). The second joint is the subtalar joint between the two largest foot bones, the talus and calcaneus, which allows inversion and eversion movement of the foot. The subtaler joint is located below the ankle joint. Finally, the transverse tarsal joint is composed of the talus and calcaneus bones on the back side, and the navicular and cuboid bones on the front side. The subtaler joint permits abduction (toe out) and adduction (toe in) movement.

The adjustability of the maximum forward lean angle $M_{FL}$ requires that the highback portion of the binding be adjustable in the direction of dorsiflexion/plantar flexion of the rider's ankle. It is therefore desirable for the highback portion to pivot about an axis that is approximately coaxial with the rider's axis for dorsiflexion of the ankle joint. However, because the dorsiflexion ankle joint is located higher than the other joints in the ankle, snowboard binding designers have had to compromise in order not to interfere with the other ankle joints, and the highback portion of prior art bindings is generally constructed to pivot about an axis that is well below the dorsiflexion ankle joint. The result is that the highback is not optimally positioned with respect to the rider's ankle over the design range of settings for the maximum forward lean angle.

As discussed above, in conventional bindings the maximum forward lean angle of the highback is adjusted by setting the position of a block member that is slidably attached to the back highback; see for example, U.S. Patent Publication No. 2006/0237920, which is hereby incorporated herein in its entirety. The block member is slidable along a back side of the highback and can be locked into place such that when the highback is at the desired maximum forward lean angle the block member abuts the heel loop, preventing any further rearward pivot.

In prior highback bindings, for example, the binding disclosed in copending U.S. patent application Ser. No. 11/114,290, which is hereby incorporated by reference in its entirety, a repositionable and lockable block member is disposed on the rear face of the highback. The block member engages or abuts a U-shaped heel loop that extends behind the highback to limit the rearward pivot of the highback. This rearward limit allows the user to apply a torque to the snowboard, for example, to aggressively dig the rearward edge of the snowboard into the snow to achieve a desired maneuver. The slidable and lockable block member permits the user to selectively adjust the maximum forward lean angle by suitably positioning the block member. The block member provides an adjustable, positive, well-defined stop to the rearward pivot of the highback.

However, the block member is relatively bulky, adds expense to the binding, and limits the designer's options when designing the highback. A need exists for a simpler mechanism for limiting the maximum forward lean angle for the highback portion of a snowboard binding, while still providing an adjustable, positive stop.

Moreover, highback flexibility is an important design aspect in snowboard bindings, and affects the performance and feel of the binding. Eliminating the need for a sliding block mechanism would allow a designer to provide a more even flexure pattern in the highback that is best suited for snowboarding performance and comfort.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A binding is disclosed that is suitable for snowboarding and the like, comprising a baseplate adapted to be adjustably attached to a snowboard, the baseplate having a lateral sidewall, a medial sidewall, and a U-shaped heel loop, wherein the heel loop has a front face defining a plurality of teeth; and a highback having a medial leg pivotably attached to the baseplate, a lateral leg pivotably attached to the baseplate, and a center portion, wherein the center portion of the highback has a rearward face defining a plurality of teeth that are sized and shaped to engage the heel loop teeth; such that a maximum forward lean angle of the highback is limited by the engagement of the highback teeth with the heel loop teeth.

In an embodiment the highback lateral and medial legs are adjustably attached to the baseplate with pivot members or mounting hardware that extend through slots in at least one of the highback and the baseplate, such that the maximum forward lean angle of the highback is adjustable by selectively adjusting the position of the pivot members in the slots. In an embodiment the slots are elongate, curved slots.

In an embodiment the highback lateral and medial legs have elongate curved slots and the highback lateral and medial legs pivotably attach to the baseplate with attachment hardware that extends through the slots, and further wherein the maximum forward lean angle of the highback is adjusted by changing the position of the attachment hardware within the slots.

In an embodiment the snowboard binding highback does not include any sliding block assembly.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1A:
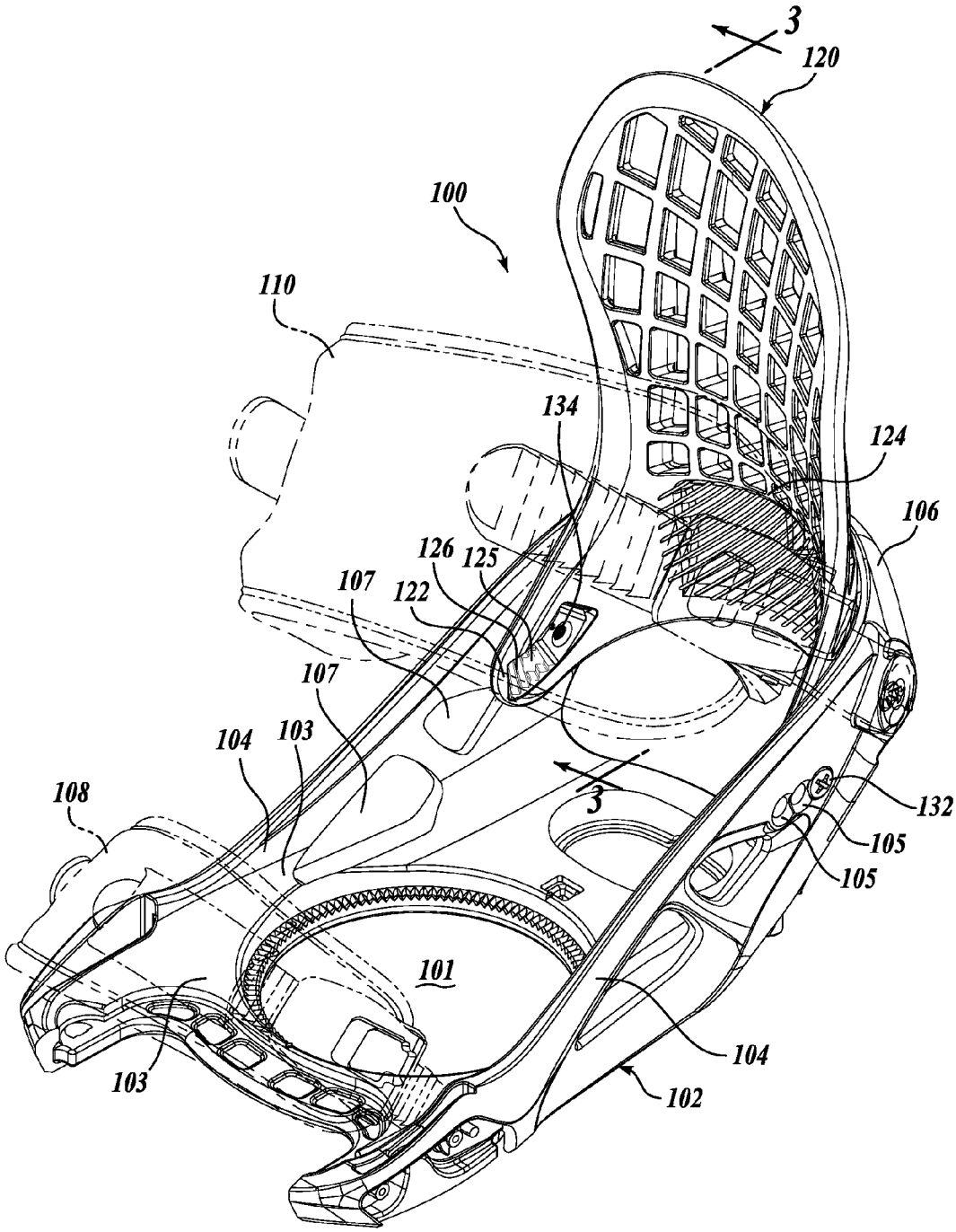
FIG. 1A is a perspective view of a blockless highback snowboard binding in accordance with the present invention, with the ankle and toe straps shown in phantom.
Figure 1B:
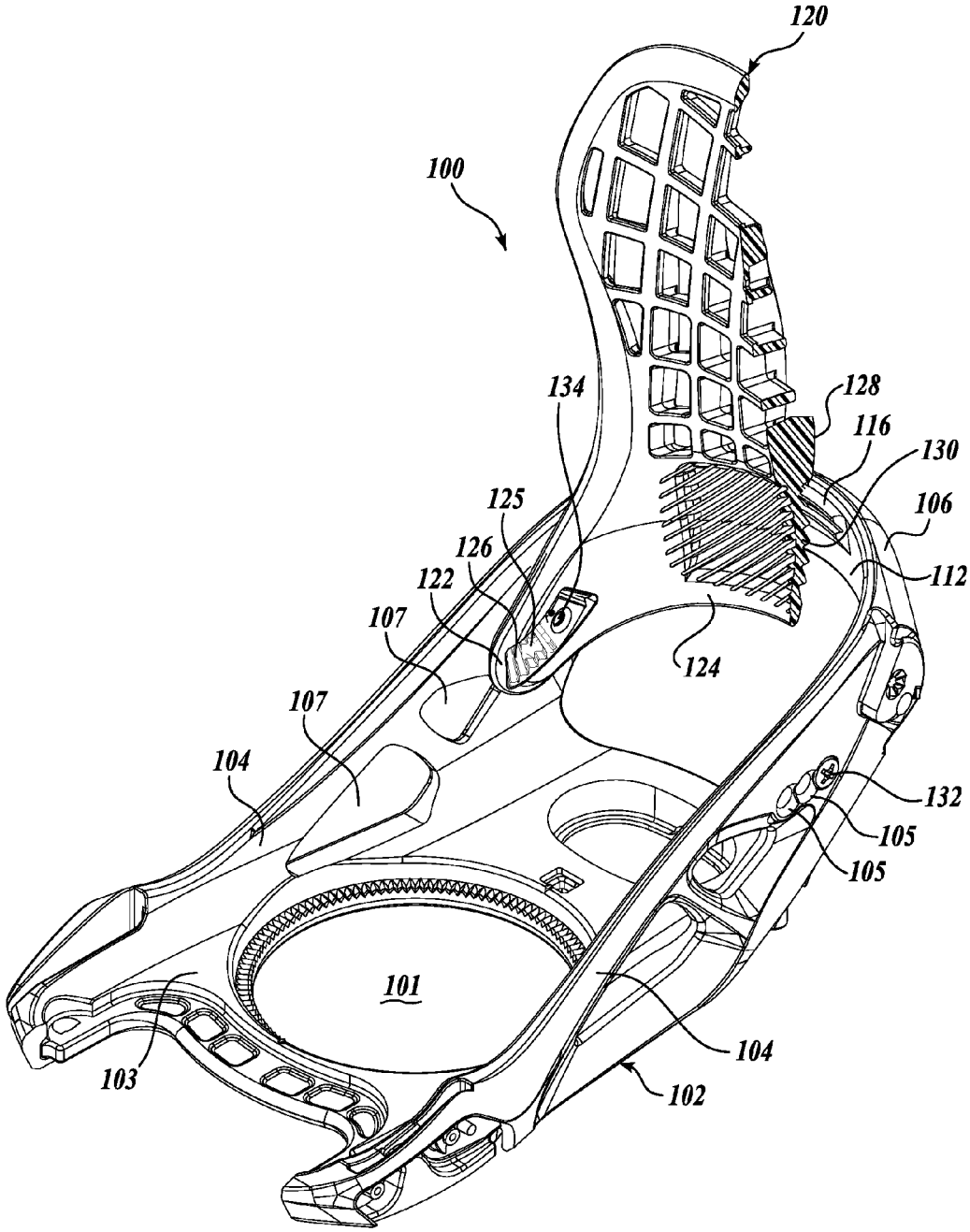
FIG. 1B shows the blockless highback binding shown in FIG. 1A, with the highback partially cut away to show details of this embodiment.
Figure 2:
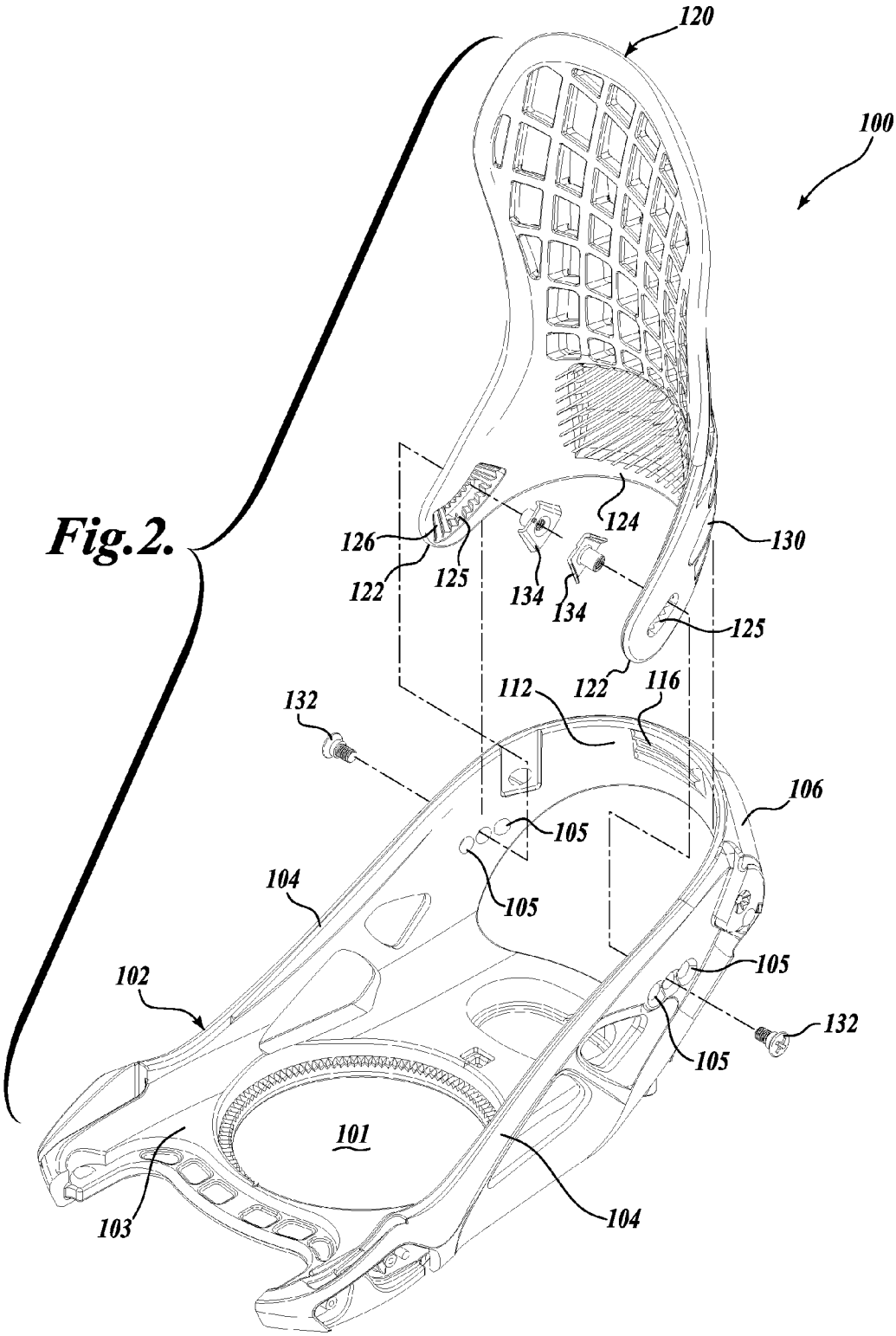
FIG. 2 is a partially exploded perspective view of the snowboard binding shown in FIG. 1.

FIG. 1A shows a perspective view of a blockless highback binding 100 in accordance with the present invention, wherein some conventional portions of the binding 100 are omitted for clarity. FIG. 1B is the same view of the blockless highback binding 100, but with a portion of the highback 120 cut away to reveal particular details of the structure of the disclosed blockless highback binding 100, and showing that the highback 120 does not include a conventional sliding block centered on its back side. A partially-exploded view of the blockless binding 100 is shown in FIG. 2.

The blockless binding 100 includes a base plate 102 that is adapted to be selectively and adjustably attached to a snowboard (not shown) by conventional attachment mechanisms as are well known in the art. For example, the illustrated baseplate 102 includes a central mounting aperture 101 that is adapted to receive a corresponding circular mounting plate (not shown) such that the angular orientation of the binding 100 relative to the snowboard may be selected. For example, in some embodiments the angular orientation is adjustable in three degree increments.

Figure 1C:
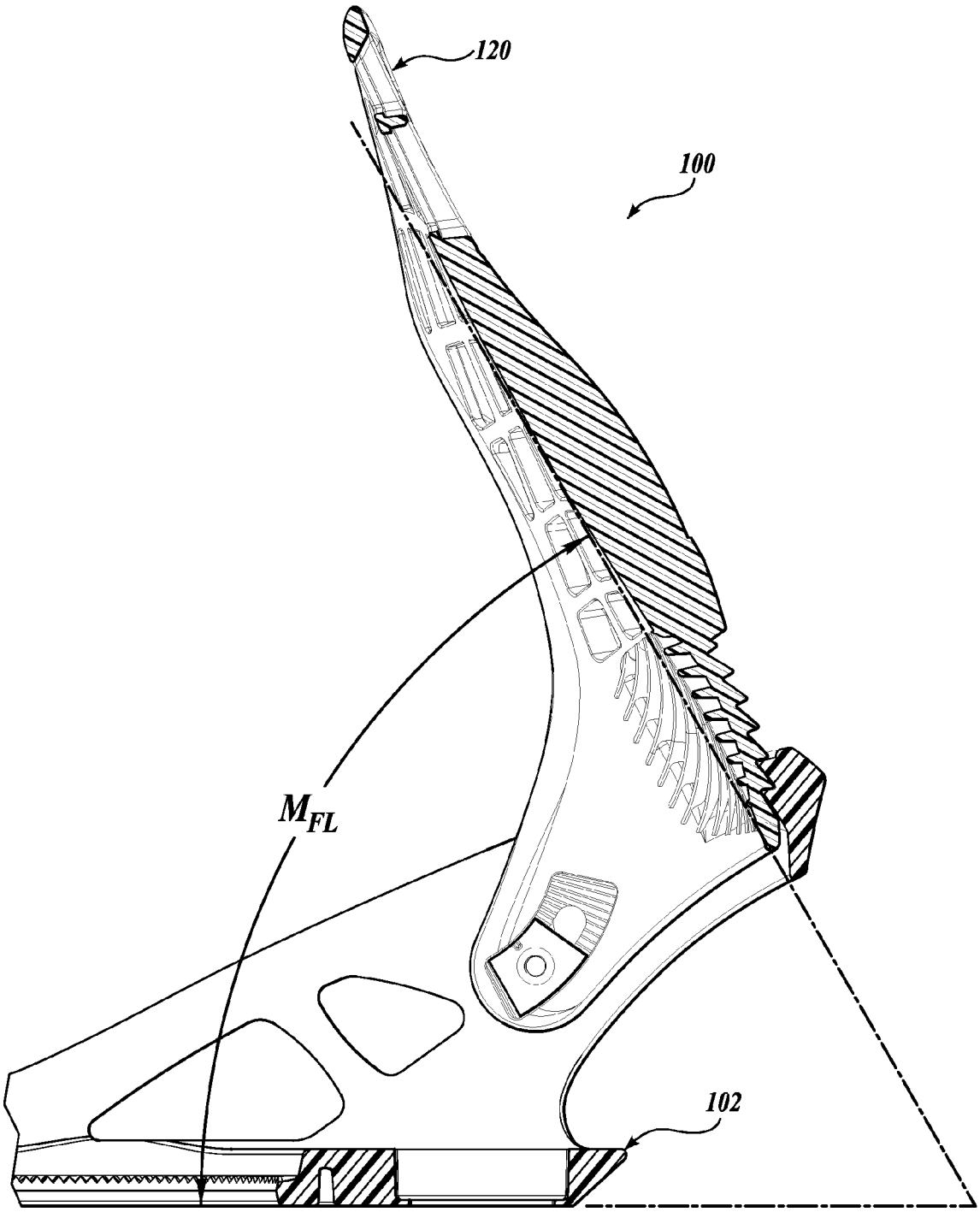
FIG. 1C is a fragmentary, cross-sectional view of the blockless highback binding shown in FIG. 1A, illustrating the maximum forward lean angle, $M_{FL}$.

The baseplate 102 defines a platform 103 for receiving a snowboard boot and includes oppositely-disposed lateral and medial sidewalls 104 and a U-shaped heel loop 106 that extends rearwardly and behind the user's foot or ankle to connect the lateral and medial sidewalls 104. The baseplate 102 may include one or more lightening apertures 107, to reduce the overall weight of the binding 100. In the embodiment of FIG. 1, the baseplate 102 comprising the platform 103, sidewalls 104, and heel loop 106 is formed as an integral unit. However, it is contemplated and well known in the art to alternatively construct a binding baseplate as an assembly, for example, attaching a heel loop to the sidewalls with attachment hardware such that the heel loop 106 may be adjusted to accommodate different-sized boots.

Typically, a toe strap assembly 108 (shown in phantom in FIG. 1A) is pivotally attached near a front end of the sidewalls 104 and positioned to overlie a toe portion of the snowboard boot, and an instep or ankle strap assembly 110 is pivotally attached to the heel loop 106 and positioned to overlie an instep portion of the snowboard boot. The toe strap assembly 108 and instep strap assembly 110 are held in a tightened adjustment about the snowboard boot with clasp mechanisms or the like, which may be ratchet-type, quick-release clasp mechanisms. The strap assemblies 108, 110 are preferably relatively wide, flexible and compliant for the rider's comfort.

Oppositely-disposed attachment apertures 105 are provided on the heel loop 106 for pivotable attachment of the highback 120, such that the highback 120 can pivot generally about a transverse, horizontal axis. In this exemplary embodiment, a plurality of sets of attachment apertures 105 are provided.

The highback 120 is contoured to approximately conform to the back of the back of the rider's boot, and comprises medial and lateral legs 122 (only one visible in FIGS. 1A and 1B) and a center portion 124 that is adapted to overlie the back of the boot. As shown in the figures, the highback 120 is sized and shaped to fit within or nest with the heel loop 106. The highback 120 is pivotably attached to the heel loop 106 with bolts 132 and nut plates 134. The bolts 132 extend through oppositely disposed attachment apertures 105 in the heel loop 106, and through corresponding slots 125 in the medial and lateral legs 122 of the highback 120. Preferably the slots 125 are disposed in toothed channels 126, and the nut plates 134 include corresponding teeth or angled edges that are sized to engage the channel teeth 126 to securely retain the highback 120 as a selected adjustment.

As seen most clearly in FIG. 1B and in FIG. 2, a front inner face 112 of the heel loop 106 defines a plurality of teeth 116, preferable approximately centered on the heel loop 106. The rearward face 128 of the highback 120 defines a plurality of disposed teeth 130 that are sized and positioned to engage at least one of the heel loop teeth 116, as discussed in more detail below. In the disclosed embodiment there are two heel loop teeth 116 and six highback teeth 130, although more or fewer heel loop teeth are contemplated.

Figure 3:
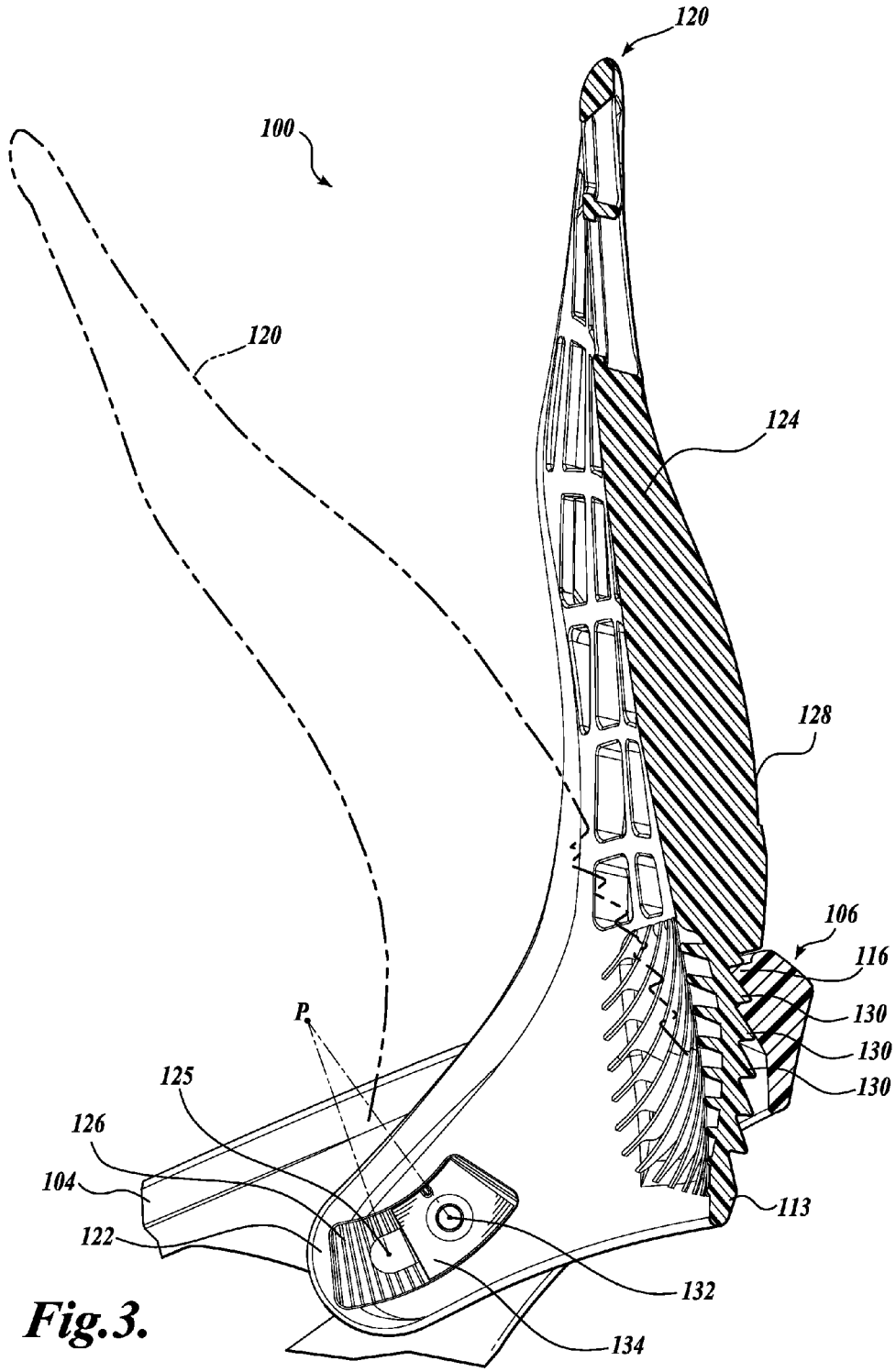
FIG. 3 is a fragmentary cross-sectional side view of the snowboard binding shown in FIG. 1.

Refer now to FIG. 3, which shows a fragmentary cross-sectional side view of the binding 100 generally through section 3-3 shown in FIG. 1A. The highback 120 is pivotably mounted to the heel loop 106 such that the highback 120 can pivot about the axis defined by the bolts 132, as indicated by the broken line showing the highback 120 pivoted forwardly. The rearward range of motion of the highback 120, i.e., the maximum forward lean angle, is limited by the heel loop 106. The maximum forward lean angle is defined above, and is shown for a particular adjustment position as angle $M_{FL}$ in FIG. 1C. It is preferred, but not required, that the heel or lower portion 113 of the highback 120 be shaped and sized so that the heel loop 106 will not interfere with forward pivot of the highback 120, such that the highback 120 can pivot substantially to a horizontal position, for example, to facilitate storage and transportation of the binding 100.

As noted above, the rear face 128 of the highback 120 includes a plurality of teeth 130 (six shown) that are sized and positioned such that one or more of the teeth 130 will engage the teeth 116 on the front face of the heel loop 106 when the highback 120 is suitably installed. The highback teeth 130 and the heel loop teeth 116 are sized, angled, and shaped such that the highback 120 can pivot freely forward without the heel loop teeth 116 interfering with the highback teeth 130. In a preferred embodiment, two or more of the highback teeth 130 engage corresponding heel loop teeth 116 approximately at the same time when the highback 120 is pivoted rearwardly to the maximum forward lean angle. The shape and position of the teeth 116, 130 therefore provide a positive, well-defined stop to the rearward pivot of the highback 120 (hereinafter referred to as the "stop position").

The slots 125 in the legs 122 of the highback 120 are arcuate, preferably shaped generally in a circular arc for a circle centered on a point P, above the sidewalls 104. The channels 126 also preferably define a circular arc, with the teeth 126 disposed approximately radially therein. Because the bolts 132 extend through the arcuate slots 125 to mount the highback 120 to the baseplate 102, the user may adjust the highback 120 about the location of the pivot axis (defined by the bolts 132) along a circular arc centered on point P. This can be best appreciated by comparing FIGS. 3 and 4.

For example, FIG. 3 shows the highback 120 disposed such that the pivot axis of the highback 120 (defined by the bolts 132) is located near the rearward end of the curved slot 125. In this position, the upper highback teeth 130 engage the heel loop teeth 116 when the highback 120 is pivoted rearwardly to its stop position.

Figure 4:
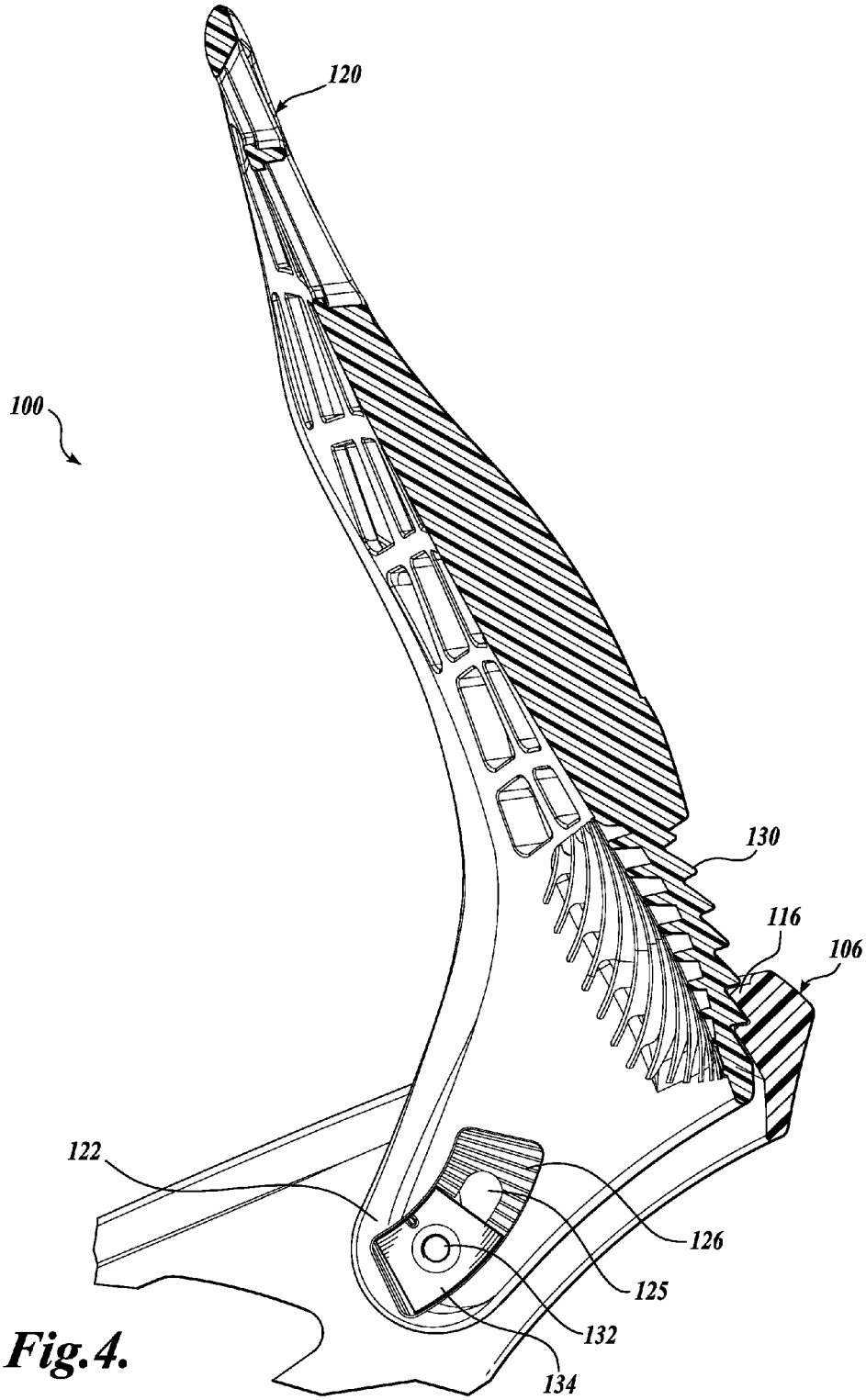
FIG. 4 is a fragmentary cross-sectional side view similar to FIG. 3, showing the highback in a different adjustment position.

FIG. 4 shows the highback 120 disposed such that the pivot axis of the highback 120 is located near the forward end of the curved slot 125. In this position, the lower highback teeth 130 engage the heel loop teeth 116 when the highback 120 is pivoted to its stop position.

The maximum forward lean angle is therefore established or set by the rider by loosening the bolts 132, positioning the highback slots 125 at a desired position with respect to the bolts 132, and re-tightening the bolts 132. Therefore, as will be appreciated by comparing FIGS. 3 and 4, the maximum forward lean angle is established by effectively pivoting the highback 120 about a horizontal axis through the point P.

Of course, during use the highback 120 pivots about the axis defined by the mounting bolts 132. The maximum forward lean angle is set by the position of the bolts 132 within the slots 125, which establishes the angle wherein the highback teeth 130 engage the heel loop teeth 130.

In particular, adjusting the highback 120 from a position wherein the bolts 132 are near the rear end of the curved slot 125 to a position wherein the bolts 132 are nearer the forward end of the curved slot 125 decreases the maximum forward lean angle (as defined above). Therefore, the rider can adjust the maximum forward lean angle without requiring a sliding block stop disposed on the rear face of the highback 120.

Although the exemplary embodiment shown in FIGS. 3 and 4 show the elongate slot 125 in the legs 122 of the highback 120 and the bolt 132 extends through an aperture 105 in the sidewalls 104, it will be apparent to persons of skill in the art that the slot 125 may instead be provided in the sidewalls 104 and fixed apertures in the highback 120, for example, to achieve the equivalent functionality.

In an embodiment of the binding 100, the channeled teeth 126 are spaced to generally correspond to the highback teeth 130, such that adjusting the highback 120 to shift the engagement of the nut plates 134 with the channeled teeth 126 by one tooth will shift the highback teeth 130 engaging the heel loop teeth 116 by one tooth. Alternatively, it is contemplated that a plurality of apertures may alternatively be used instead of the curved slot 125, and arranged such that the displacement by one aperture would produce a corresponding displacement of the highback teeth 130 that engage the heel loop teeth 116.

Elimination of the block member provides many advantages, in addition to reducing the number of parts required and corresponding reductions in cost. It also gives the designer greater freedom in designing the highback 120, because the designer is not constrained by the requirement for a block member. In FIG. 1, for example, a highback 120 is disclosed having a relatively large number of openings or apertures through the highback virtually along its entire extent. This allows the highback 120 to be much lighter than a conventional highback, and to permit the highback 120 to be more flexible or to have other mechanical and/or aesthetic characteristics not available in a conventional blocked highback binding. Highback flexibility is an important performance feature in snowboard bindings. The binding disclosed herein provides a positive and adjustable stop position defining the maximum forward lean angle, $M_{FL}$, without requiring a sliding block mechanism. Elimination of these components allows the designer to create a more even flex pattern in the highback. The blockless design may also enable the use of particular materials that would not be suitable with a highback that must accommodate a sliding block.

Although the currently preferred binding 100 is shown with arcuate slots 125, it will be apparent to persons of skill in the art that similar results could be obtained using a straight slot over a range of motion (or a range of maximum forward lean angle), albeit with less optimal engagement of the highback teeth and heel loop teeth. Also, although the channel teeth 126 and nut plate 134 locking mechanism is currently preferred, other means for locking the highback adjustment at a particular position are known and could be utilized, including, for example, utilizing spaced apertures rather than a continuous slot, or relying solely on the frictional fit provided by the bolt and nut plate.

While illustrative embodiments have been illustrated and described, it will be appreciated that various changes can be made therein without departing from the spirit and scope of the invention.

The embodiments of the invention in which an exclusive property or privilege is claimed are defined as follows:

1. A snowboard binding comprising:

a baseplate adapted to be adjustably attached to a snowboard, the baseplate having a heel loop, wherein the heel loop has a front face defining at least one tooth; and a highback having a medial leg pivotably attached to the baseplate, a lateral leg pivotably attached to the baseplate, and a center portion, wherein the center portion of the highback has a rearward face defining a plurality of teeth that are sized and shaped to engage the heel loop at least one tooth;

such that a maximum forward lean angle of the highback is reached when the highback pivots towards the heel loop until one or more of the highback teeth engage with the heel loop at least one tooth; and further wherein the highback pivots freely forward away from the heel loop without the at least one tooth of the heel loop interfering with the highback teeth.

2. The snowboard binding of claim 1, wherein the highback lateral and medial legs are adjustably attached to the baseplate with pivot members that extend through slots in at least one of the highback and the baseplate, such that the maximum forward lean angle of the highback is adjustable by selectively adjusting the position of the pivot members in the slots.

3. The snowboard binding of claim 2, wherein the highback does not include a sliding block assembly.

4. The snowboard binding of claim 3, wherein the slots are elongate, curved slots.

5. The snowboard binding of claim 1, wherein the highback lateral and medial legs further comprise slots, and wherein the highback lateral and medial legs pivotably attach to the baseplate with attachment hardware that extends through the slots, and further wherein the maximum forward lean angle of the highback is adjusted by changing the position of the attachment hardware within the slots.

6. The snowboard binding of claim 5, wherein the slots are shaped arcuate.

7. The snowboard binding of claim 6, wherein the slots are disposed in toothed channels, and wherein the attachment hardware for attaching the highback to the baseplate engages the toothed channels.

8. The snowboard binding of claim 6, wherein the baseplate further comprises lateral and medial sidewalls, and wherein the arcuate slots are circular arcs along a circle centered on an axis located above the medial and lateral sidewalls.

9. The snowboard binding of claim 1, wherein the highback is blockless.

10. The snowboard binding of claim 1, wherein the heel loop is adjustably attached to the baseplate, whereby the binding will accommodate different boot sizes.

11. The snowboard binding of claim 1, wherein the heel loop at least one tooth comprises two teeth.

12. A binding for a gliding board comprising:

a baseplate configured for attachment to a gliding board, the baseplate comprising lateral and medial sidewalls and a heel loop, wherein the heel loop includes a front face portion having at least one tooth member that extends forwardly from the front face; and a highback adjustably and pivotably attached to the lateral and medial sidewalls, wherein the highback includes a rear face having a plurality of teeth that extend rearwardly from the highback;

wherein the plurality of highback teeth are positioned such that the highback reaches a maximum forward lean angle when the highback pivots toward the heel loop until one or more of the plurality of highback teeth engage with the at least one heel loop tooth; and further wherein the highback pivots freely forward away from the heel loop without the at least one tooth of the heel loop interfering with the highback teeth.

13. The binding of claim 12, wherein the highback is pivotably attached to the sidewalls with mounting hardware that extends through slots, such that the maximum forward lean angle is adjusted by adjusting the position of the mounting hardware with respect to the slots.

14. The binding of claim 13, wherein the slots are curved.

15. The binding of claim 13, wherein the slots define a circular arc along a circle centered on a point disposed above the lateral and medial sidewalls.

16. The binding of claim 15, wherein the highback comprises lateral and medial legs, and the slots are disposed in the lateral and medial legs of the highback.

17. The binding of claim 16, further comprising a toothed channel in each of the lateral and medial legs of the highback, and wherein the slots are disposed in the toothed channels.

18. The binding of claim 17 wherein the mounting hardware includes two sets of mounting hardware, each set of mounting hardware comprising a bolt that extends through one of the slots, and a nut plate disposed in one of the channels.

19. The binding of claim 12, wherein the highback is blockless.

20. The binding of claim 12, wherein the heel loop is adjustably attached to the baseplate sidewalls.

21. A snowboard binding comprising:

a baseplate having a heel loop, wherein the heel loop has a front face; and a highback pivotably attached to the baseplate, the highback having a rearward face that is positioned to engage the front face of the heel loop during pivoting;

wherein one of the heel loop front face and the highback rearward face includes at least one tooth and the other of the heel loop front face and the highback rearward face includes a plurality of teeth, the at least one tooth being sized and shaped to engage the plurality of teeth when the highback rearward face is pivoted to engage the heel loop front face;

such that a maximum forward lean angle of the highback is limited by the highback pivoting toward the heel loop until the engagement of the at least one tooth with the plurality of teeth; and further wherein the highback pivots freely forward away from the heel loop without the at least one tooth interfering with the plurality of teeth.

22. The snowboard binding of claim 21, wherein the highback comprises lateral and medial legs that are adjustably attached to the baseplate with pivot members that extend through slots in at least one of the highback and the baseplate, such that the maximum forward lean angle of the highback is adjustable by selectively adjusting the position of the pivot members within the slots.

23. The snowboard binding of claim 22, wherein the highback does not include a sliding block assembly.

24. The snowboard binding of claim 22, wherein the slots are elongate, curved slots.

* * * * *